US005905013A

United States Patent [19]

Seto

[11] Patent Number: 5,905,013

[45] Date of Patent: May 18, 1999

[54] IMAGE FORMING APPARATUS

[75] Inventor: Mitsuru Seto, Yamakita-machi, Japan

[73] Assignee: Ricoh Company, Ltd., Tokyo, Japan

[21] Appl. No.: 08/886,353

[22] Filed: Jul. 1, 1997

[30] Foreign Application Priority Data

Jul. 1, 1996 [JP] Japan ..... 8-191520

[51] Int. Cl.[6] ..... G03G 13/16

[52] U.S. Cl. ..... 430/126; 399/308

[58] Field of Search ..... 430/126; 399/128, 399/307, 308

[56] References Cited

U.S. PATENT DOCUMENTS 5,187,526 2/1993 Zaretsky ..... 355/273
5,729,799 3/1998 Numao et al. ..... 399/128

FOREIGN PATENT DOCUMENTS 7-128997 5/1995 Japan .
8-202177 8/1996 Japan .

*Primary Examiner*—John Goodrow
*Attorney, Agent, or Firm*—Oblon, Spivak, McClelland, Maier & Neustadt, P.C.

[57] ABSTRACT

An image forming apparatus of the type transferring a toner image from an image carrier to an intermediate transfer body by primary transfer, and transferring it from the intermediate transfer body to a recording medium by secondary transfer is disclosed. Before the primary transfer, a charge of the same polarity as the charge of the toner image is deposited on the intermediate transfer body. The charge deposited on the transfer body reduces the scattering or blurring of the toner image apt to occur when toners of different colors are superposed, without deteriorating the paper-free feature of the apparatus.

19 Claims, 4 Drawing Sheets

⊖ : TONER CHARGE

⊖ : DISCHARGED CHARGE

IMAGE FORMING APPARATUS

BACKGROUND OF THE INVENTION

1. Field of the Invention

The present invention relates to a copier, facsimile apparatus, printer or similar image forming apparatus and, more particularly, to an image forming apparatus of the type transferring a toner image from an image carrier to an intermediate transfer body (primary transfer) and then transferring the image from the intermediate transfer body to a paper or similar recording medium (secondary transfer).

2. Discussion of the Background

An electrophotographic image forming apparatus capable of copying or printing full-color images is extensively used today. Two different systems are available with this type of image forming apparatus for transferring a full-color image to a paper or similar recording medium, as follows.

(a) Transfer drum system: Yellow (Y), magenta (M), cyan (C) and black (Bk) toner images are sequentially formed on a photoconductive drum or similar image carrier and transferred to a paper retained on a transfer drum one upon the other.

(b) Intermediate transfer system: Y, M, C and Bk toner images are sequentially formed on a photoconductive drum or similar image carrier and transferred to an intermediate transfer body one upon the other in a primary transfer region. Then, the resulting full-color toner image formed on the intermediate transfer body is transferred to a paper in a secondary transfer region.

The intermediate transfer system (b) is advantageous over the transfer drum system (a) in that it has a paper-free feature, i.e., it can transfer toner images even to, e.g., thick papers. In addition, the system (b) is free from the problem of the system (a) that an image cannot be formed in the leading edge portion of a paper which is clamped on the transfer drum.

In the above system (a), a paper must be wrapped around a film covering the surface of the transfer drum. To electrostatically retain the paper on the film, the film is formed of an insulating material. By contrast, the system (b) does not wrap a paper around the intermediate transfer body, so that the transfer body can be formed of a material having a medium electric resistance (volume resistivity of $10^7$ Ω cm to $10^{14}$ Ω cm). A charge deposited on a material having a medium electric resistance attenuates naturally with a given time constant. Therefore, the system (b) does not need discharging means for forcibly dissipating the deposited transfer charge. Such discharging means is essential with the system (a) using the insulator. It follows that the system (b) successfully reduces ozone and saves power while achieving the paper-free feature and full-surface copy.

However, the problem with the intermediate transfer body implemented by a material having a medium resistance is that the material is electrically unstable, compared to an insulator. As a result, characters and lines transferred to the transfer body are apt to suffer from a defect generally referred to as scattering or blurring.

The following approaches (1)–(5) have heretofore been proposed in order to obviate the scattering or blurring of images particular to the system (b).

(1) After toner of high resistance has been non-electrostatically transferred to an intermediate transfer medium, a heat roller is pressed against the transfer medium with the intermediary of a paper so as to effect transfer and fixation (Japanese Patent Laid-Open Publication No. 63-34570).

(2) After conductive toner has been non-electrostatically transferred to an intermediate transfer medium, a heat roller is pressed against the transfer medium with the intermediary of a paper so as to effect transfer and fixation (Japanese Patent Laid-Open Publication No. 63-34571).

(3) Every time a toner image is transferred to an intermediate transfer medium, a charger for peeling a paper discharges the toner image (Japanese Patent Laid-Open Publication No. 1-282571).

(4) A higher transfer potential is assigned to the last transfer step than to the immediately preceding transfer step. In addition, a preselected voltage is applied to an intermediate transfer body during the interval between consecutive transfer steps.

(5) Means is provided for discharging a charge deposited on an intermediate transfer body at a position preceding means for transferring a toner image from the transfer body to a paper (Japanese Patent Laid-Open Publication No. 4-147170).

However, the above approaches (1) and (2) are difficult to achieve the paper-free feature although successfully obviating the scattering of toner due to the transfer and fixation using a pressure. The approaches (3)–(5), each needing discharging means, cannot sufficiently reduce ozone or save power (advantage particular to a medium resistance material) although successfully obviating the scattering of toner in a monocolor mode; it is noteworthy, however, that the system (b) using a medium resistance material halves the number of discharging means, compared to the system (a) using an insulator. Another problem with the approaches (3)–(5) is that when two to four different colors are transferred one upon the other, the scattering of toner cannot be sufficiently reduced.

The scattering of toner to occur when different colors are superposed will be described hereinafter. For the analysis of scattering particular to the primary transfer, use was made of a conventional ordinary color copier. Scattering on an intermediate transfer belt was observed after the primary transfer effected in each of C and M monocolor modes and in each of C→M and M→C bicolor modes. The observation showed that the toners were scattered little in the monocolor modes. In the bicolor modes, the toner of the first color (transferred first) was scattered little as in the monocolor modes without regard to the kind of toner, but the toner of the second color was partly scattered around image portions. For such experiments, the toners were deposited in an amount of 0.56 mg/cm$^2$ in the monocolor modes and in an amount of about 1.1 mg/cm$^2$ in the bicolor modes.

The above experiments were repeated except that the developing conditions were so selected as to double the amount of toner deposition. It was found that the toners were scattered even in the monocolor modes to the same degree as in the bicolor modes of the previous experiments. Moreover, in the bicolor modes, each toner of the second color was scattered more than in the bicolor modes of the previous experiments.

As the above experiments indicate, when two to four colors are transferred one upon the other, the scattering becomes more conspicuous as the amount of toner to deposit on the intermediate transfer belt increases. Further, the experiments showed that the scattering did not occur at a position upstream of a primary transfer region, but occurred at a position downstream of a nip for image transfer (between the nip and a transfer bias roller). Further, in each monocolor mode, the scattering occurred at a position upstream of the above nip, i.e., at the inlet of the nip.

A color copier using the transfer drum system was remodeled for evaluation. Scattering on a transfer drum was observed after the primary transfer effected in each of the same monocolor modes and bicolor modes, while varying the amount of toner deposition. Substantially the same degree of scattering occurred in both the monocolor modes and bicolor modes, but the scattering of the second color was not as noticeable as in the intermediate transfer system. Moreover, while the scattering tends to decrease with an increase in the amount of toner deposition, the transfer drum system is obviously superior to the intermediate transfer system for the amount of toner deposition of about 1 $mg/cm^2$.

It follows that the scattering of toner to occur when different colors are superposed (or when the amount of toner deposition is great) can be considered as a problem particular to the intermediate transfer system using a medium resistance material.

The scattering of toner to occur in a monocolor mode will be described hereinafter. To transfer toner from a photoconductive element to an intermediate transfer body, a preselected transfer voltage is applied to a nip where the two members contact each other. The resulting charge forms a n electric field for image transfer at the above nip and causes the toner to be electrostatically transferred from the photoconductive element to the intermediate transfer body. When the intermediate transfer body is implemented by the previously stated medium resistance material, the charge deposited on the transfer body partly leaks to the outside of the nip. Specifically, when the transfer body is formed of an insulator, the charge deposited thereon remains at the same position. However, when use is made of a medium resistance material, the charge deposited on the transfer body moves away from the expected position. The movement of the charge occurs toward the upstream side and downstream side, with respect to the direction of movement of the transfer body, away from the position where the charge has been deposited on the transfer body. If the charge moves to the inlet of the nip, i.e., a gap immediately preceding the position where the photoconductive element and transfer body contact each other, the charge forms an electric field on the transfer body at the inlet of the nip. This electric field causes the toner transfer from the photoconductive element to the transfer body to occur before the latter contacts the former (so-called pretransfer). The pretransfer occurs at a position slightly deviated from the position of transfer at the nip, resulting in the scattering.

SUMMARY OF THE INVENTION

It is therefore an object of the present invention to provide an image forming apparatus capable of reducing, in the event of superposition of toners of different colors, the scattering of the toners without deteriorating the paper-free feature.

It is another object of the present invention to provide an image forming apparatus capable of reducing the scattering in the event of a monocolor mode.

In accordance with the present invention, an image forming apparatus includes an image carrier for carrying a toner image thereon. A primary transfer electrode effects the primary transfer of the toner image from the image carrier to an intermediate transfer body electrostatically. A secondary transfer electrode effects the secondary transfer of the toner image from the intermediate transfer body to a recording medium electrostatically. A charge depositing member deposits, before the primary transfer, a charge identical in polarity with the charge of the toner image on the intermediate transfer body.

Also, in accordance with the present invention, an image forming apparatus has an image carrier for carrying a toner image thereon, and an intermediate transfer body to which the toner image is transferred from the image carrier. Assuming that the intermediate transfer body has a volume resistivity of $\rho V$ and a specific inductive capacity of $\epsilon B$, ($\rho V$, $\epsilon B$) satisfies a relation:

$$L1/VL \ll \epsilon 0 \cdot \epsilon B \cdot \rho V < L2/VL$$

wherein L1 is the circumferential length of the intermediate transfer body between a charge depositing position preceding a primary transfer position and a primary transfer bias roller, L2 is the circumferential length of the intermediate transfer body between a primary transfer nip position and a secondary transfer bias roller, VL is the linear velocity of the intermediate transfer body, and $\epsilon 0$ is a vacuum dielectric constant.

Further, in accordance with the present invention, an image forming method has a primary transfer step for transferring a toner image from an image carrier to an intermediate transfer body electrostatically, a secondary transfer step for transferring the toner image from the intermediate transfer body to a recording medium electrostatically, and a step of depositing a charge identical in polarity with the toner image on the intermediate transfer body before the primary transfer step.

Moreover, in accordance with the present invention, an image forming method has a primary transfer step for transferring a toner image from an image carrier to an intermediate transfer body electrostatically, and a secondary transfer step for transferring the toner image from the intermediate transfer body to a recording medium electrostatically. A transfer charge deposited on the intermediate transfer body is reduced at a position where the image carrier and intermediate transfer body contact each other.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
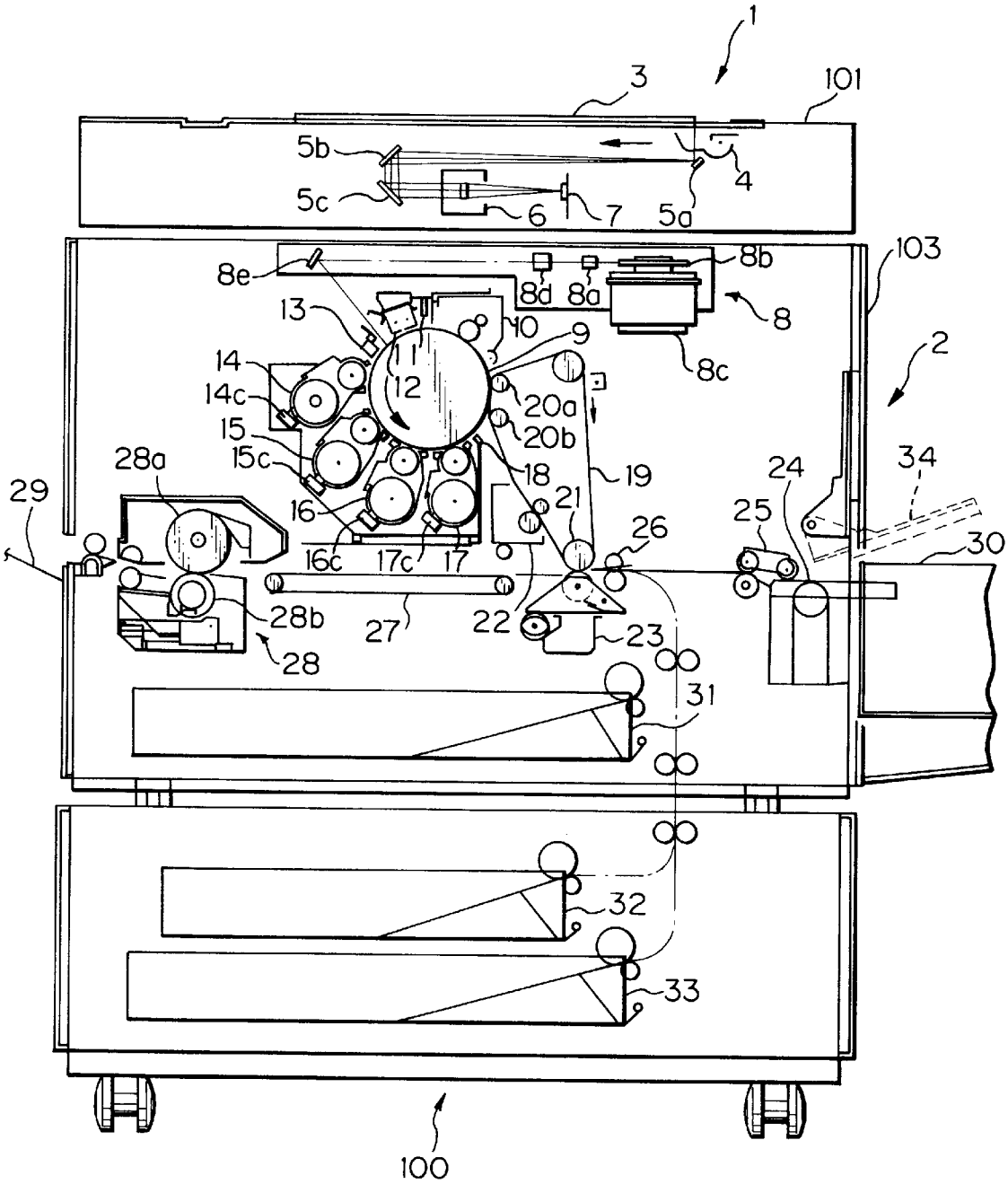
FIG. 1 is a section showing an image forming apparatus embodying the present invention.
Figure 2:
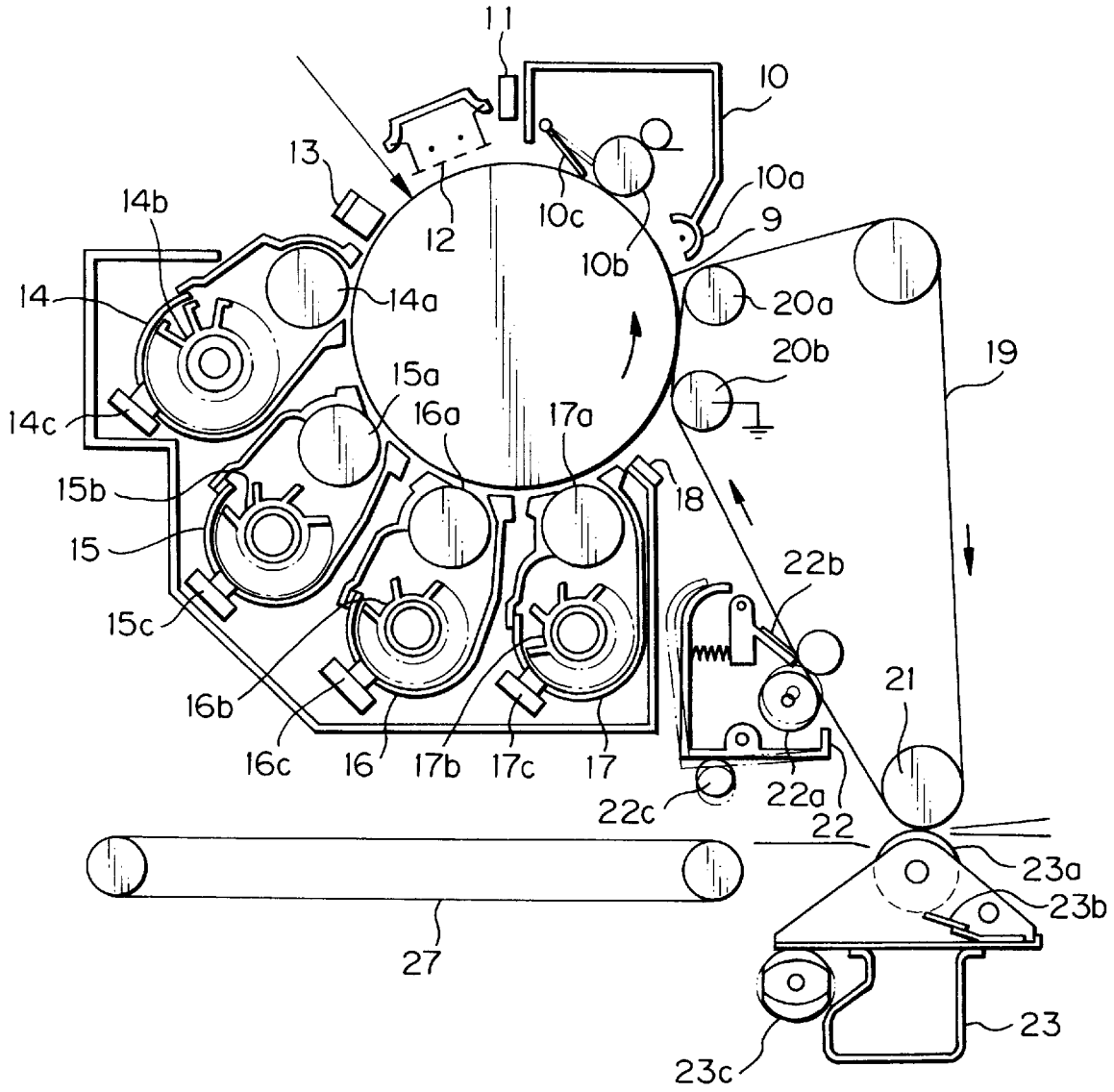
FIG. 2 is an enlarged section showing a photoconductive drum included in the embodiment and various units arranged around the drum.

Referring to FIGS. 1 and 2 of the drawings, an image forming apparatus embodying the present invention is shown and implemented as an electrophotographic copier by way of example. As shown, the copier, generally 100, includes a color scanner or image reading device 1 having a lamp 4, mirrors 5*a*–5*c*, a lens 6, and a color image sensor 7. While the lamp 4 illuminates a document 3, an imagewise reflection from the document 3 is incident to the image sensor 7 via the mirrors 5*a*–5*c* and lens 6. The image sensor 7 reads color image data represented by the incident reflection color by color, e.g., blue (B), green (G), and red (R), and transforms them to corresponding electric image signals. In the illustrative embodiment, the image sensor 7 is made up of B, G and R color separating means and CCDs (Charge Coupled Devices) or similar photoelectric transducers so as to read the three colors at a time. An image processing section, not shown, performs color conversion based on the levels of B, G and R image signals output from the color scanner 1, and produces Bk, C, M and Y color image data. The Bk, C, M and Y color image data are fed from the image processing section to a color printer or image recording device 2. In response, the color printer 2 forms a composite Bk, C, M and Y toner image on a paper and thereby outputs a color copy.

To output the Bk, C, M and Y image data, the color scanner 1 receives a scanner start signal timed in relation to the operation of the color printer 2. In response, the scanner 1 causes its illumination and mirror optics to move to the left, as indicated by an arrow in FIG. 1, while scanning the document 3. Image data of one color is produced every time the above optics scan the document 3. The color printer 2 sequentially forms toner images of different colors in response to such image data while superposing them, thereby producing a quadricolor or full-color image. The color printer 2 includes an optical writing unit 8.

The writing unit 8 transforms the color image data received from the color scanner 1 to an optical signal, and writes an image corresponding to the document image optically on a photoconductive drum 9. As a result, a latent image representative of the document image is electrostatically formed on the drum 9. The writing unit 8 includes a laser 8*a*, a laser driver, not shown, a polygonal mirror 8*b*, a motor 8*c* for driving the mirror 8*b*, an f/θ lens 8*d*, and a mirror 8*e*.

The drum 9 is rotatable counterclockwise, as indicated by an arrow in FIGS. 1 and 2. As shown in FIG. 2, formed around drum 9 are a drum cleaning unit (including a precleaning discharger) 10, a discharge lamp 11, a charger 12, a potential sensor 13, a Bk developing unit 14, a C developing unit 15, a M developing unit 16, a Y developing unit 17, an optical sensor for sensing a density pattern for development, and a belt or intermediate transfer body 19.

The Bk, C, M and Y developing units 14, 15, 16 and 17 respectively include developing sleeves 14*a*, 15*a*, 16*a* and 17*a*, paddles 14*b*, 15*b*, 16*b* and 17*b*, and toner content sensors 14*c*, 15*c*, 16*c* and 17*c*. The developing sleeves 14*a*–17*a* each rotates with a developer contacting the surface of the drum 9 for developing the latent image. The paddles 14*b*–17*b* each rotates in order to scoop up and agitate the associated developer. The toner content sensors 14*c*–17*c* each is responsive to the toner content of the associated developer. While the copier 1 is in its stand-by state, the developers in all of the four developing units 14–17 and existing on the sleeves 14*a*–17*a* are held in their inoperative condition. The copying operation will be outlined hereinafter on the assumption that color images are developed in the order of Bk, C, M and Y by way of example.

The color scanner 1 starts reading Bk image data out of the document 3 at a preselected timing. Optical writing and latent image formation start in response to the image data. A latent image based on the Bk image data will be referred to as a Bk latent image. Likewise, latent images based on C, M and Y image data will be referred to as a C latent image, a M latent image, and a Y latent image, respectively. Before the leading edge of the Bk latent image arrives at a Bk developing position assigned to the Bk developing unit 14, the sleeve 14*a* is caused to start rotating in order to bring a Bk developer to its operative position. As a result, the Bk latent image is developed by the Bk developer or toner. As soon as the trailing edge of the Bk latent image moves away from the Bk developing position, the developer on the sleeve 14*a* is brought to its inoperative position. This is completed at least before the leading edge of the following C latent image arrives. To bring the Bk developer to its inoperative position, the sleeve 14*a* is rotated in the reverse direction.

The Bk toner image is transferred from the drum 9 to the surface of the intermediate transfer belt 19 which is driven at the same speed as the drum 9. Let the image transfer from the drum 9 to the intermediate transfer belt 19 be referred to as primary transfer (or sometimes belt transfer). For the primary transfer, a preselected bias voltage is applied to a transfer bias roller 20*a* while the drum 9 and belt 19 are held in contact. In this manner, the Bk, C, M and Y toner images sequentially formed on the drum 9 are sequentially transferred to the belt 19 in accurate register with each other. The resulting quadricolor image is transferred from the belt 19 to a paper at a time. The configuration of a belt unit including the belt 19 will be described in detail later.

After the above Bk image forming step, the color scanner 1 starts reading C image data out of the document 3 at a preselected timing. As a result, a C latent image based on the C image data is formed on the drum 9 by optical laser writing.

In the C developing unit 15, the developing sleeve 15*a* starts rotating after the trailing edge of the Bk latent image has moved away from a C developing position, but before the leading edge of the C latent image arrives at the C developing position. As a result, a C developer or toner is brought to its operative position and develops the C latent image. As soon a s the trailing edge of the C toner image moves away from the C developing position, the C developer on the sleeve 15*a* is rendered inoperative like the Bk developer stated earlier. This is also completed before the leading edge of the following M latent image arrives.

M and Y image forming steps will not be described because they are similar to the Bk and C steps as to the reading of image data, the formation of a latent image, and development.

The belt 19 is passed over a drive roller 21, a ground roller 20*b* and a plurality of driven rollers as well as over the previously mentioned transfer bias roller 20*a*. A motor, not shown, drives the belt 19 via the drive roller 21. A belt cleaning unit 22 includes a brush roller 22*a*, a rubber blade 22*b*, and a mechanism 22*c* for moving the unit 22 into and out of contact with the belt 19. While the primary transfer of the second, third and fourth colors following the first color or Bk is under way, the mechanism 22*c* holds the entire unit 22 spaced from the belt 19.

A paper transfer unit 23 transfers the quadricolor image from the belt 19 to a paper and includes a paper transfer bias roller 23*a*, a roller cleaning blade 23*b*, and a mechanism 23*c* for moving the unit 23 into and out of contact with the belt 19. The bias roller 23*a* is usually spaced from the belt 19. At the time when the quadricolor image is to be transferred from the belt 19 to a paper, the bias roller 23*a* is pressed against the belt 19 by the mechanism 23*c*. In this condition, a preselected bias voltage is applied to the bias roller 23*a* for the transfer of the image. Let the image transfer from the belt 19 to the paper be referred to as secondary transfer (or sometimes paper transfer).

As shown in FIG. 1, a pick-up roller 25 and a registration roller feed a paper 24 when the belt 19 brings the leading edge of the quadricolor image carried thereon to a paper transfer position.

After the first or Bk toner image has been transferred from the drum 9 to the belt 19 up to its trailing edge, the belt 19 may be driven by any one of the following three different systems (1)–(3). If desired, two or more of the systems (1)–(3) may be efficiently combined in accordance with the copy size in the copying speed aspect.

(1) Constant Speed Forward System i) Even after the primary transfer of the Bk toner image, the belt 19 is continuously moved forward at a constant speed.

ii) The C toner image is formed on the drum 9 at such a timing that when the leading edge of the Bk toner image again arrives at a primary transfer position where the belt 19 contacts the drum 9, the leading edge of the C toner image also arrives thereat. As a result, the C toner image is transferred to the belt 19 over and in accurate register with the Bk toner image.

iii) This is followed by the M and Y image forming steps. Consequently, the quadricolor toner image is completed on the belt 19.

iv) The quadricolor toner image is transferred from the belt 19 moving forward at the same speed to the paper 24.

(2) Skip Forward System i) After the primary transfer of the Bk toner image, the belt 19 is released from the drum 9 and caused to skip forward at a high speed. On moving a preselected distance, the belt 19 is caused to move at its original speed and is again brought into contact with the drum 9.

ii) The C toner image is formed on the drum 9 at such a timing that when the leading edge of the Bk toner image again arrives at the primary transfer position, the leading edge of the C toner image also arrives thereat. As a result, the C toner image is transferred to the belt 19 over and in accurate register with the Bk toner image.

iii) This is followed by the M and Y image forming steps. Consequently, the quadricolor toner image is completed on the belt 19.

iv) The quadricolor toner image is transferred from the belt 19 moving forward at the same speed to the paper 24.

(3) Back-And-Forth (Quick Return) System i) After the primary transfer of the Bk toner image, the belt 19 is released from the drum 9, brought to a stop, and moved in the opposite direction, or returned, at a high speed. The return of the belt 19 is stopped after the leading edge of the Bk image on the belt 19 has moved away from the primary transfer position in the reverse direction and then moved a preselected additional distance. In this condition, the belt 19 is held in its stand-by position.

ii) When the leading edge of the C toner image formed on the drum 9 arrives at a preselected position short of the primary transfer position, the belt 19 is again moved forward and brought into contact with the drum 9. Again, the primary transfer is effected under the condition allowing the C toner image to be brought into accurate register with the Bk image on the belt 19.

iii) This is followed by the M and Y image forming steps. Consequently, the quadricolor toner image is completed on the belt 19.

iv) After the primary transfer of the fourth or Y toner image, the belt 19 is moved forward at the same speed without being returned. As a result, the quadricolor toner image is transferred from the belt 19 to the paper 24.

The paper 24 carrying the composite toner image thereon is conveyed to a fixing unit 28 by a conveyor unit 27. In the fixing unit 28, a heat roller 28*a* controlled to a preseleted temperature and a press roller 28*b* fix the toner image on the paper 24 by heat. The paper 24 coming out of the fixing unit 28 is driven toward a copy tray 29 as a full-color copy.

As shown in FIG. 2, the drum cleaning unit 10 cleans the surface of the drum 9 after the primary transfer with a precleaning discharger 10*a*, a brush roller 10*b*, and a rubber blade 10*c*. The discharge lamp 11 discharges the cleaned surface of the drum 9 uniformly. After the primary transfer, the cleaning unit 22 is again pressed against the belt 19 by the mechanism 22*c* in order to clean the surface of the belt 19.

In a repeat copy mode, the operation of the color scanner 1 and the formation of an image on the drum 9 are effected such that after the first Y (fourth color) image has been formed, the second Bk (first color) begins to be formed at a preselected timing. Also, the belt 19 is driven such that the second Bk toner image is transferred from the drum 9 to the part of the belt 19 having been cleaned by the cleaning unit 22. This is followed by the same procedure as described in relation to the first color copy.

Also shown in FIG. 1 are paper cassettes 30, 31, 32 and 33 each being loaded with papers of particular size. When the operator of the copier 1 inputs a desired paper size on an operation panel, not shown, the papers of the designated size are sequentially fed from the associated cassette toward the registration roller 26. The reference numeral 34 designates a manual tray for allowing the operator to feed, e.g., OHP (Overhead Projector) sheets or relatively thick sheets by hand.

The above description has concentrated on a quadricolor or full-color copy mode. In a tricolor or bicolor copy mode, the above procedure will be repeated a number of times corresponding to the desired number of colors and the desired number of copies. In a monocolor mode, only the developing unit corresponding to the desired color will be continuously operated until a desired number of copies have been produced; the belt 19 will be moved forward at a constant speed in contact with the drum 9, and the belt cleaning unit 22 will be held in contact with the belt 19.

The copier 1 additionally includes an implementation for reducing the scattering of toner discussed earlier without deteriorating the paper-free feature, as follows.

Figure 3:
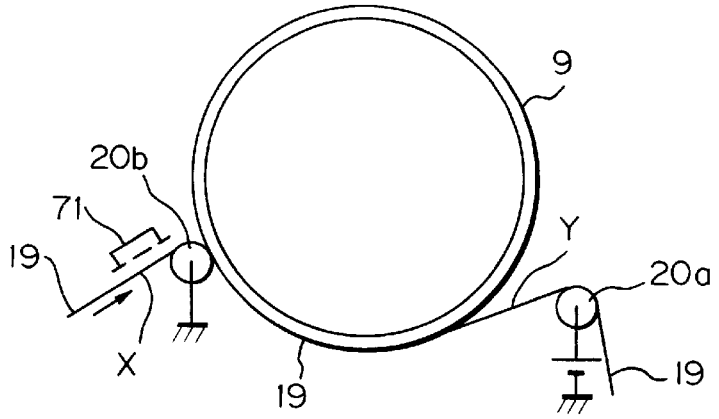
FIG. 3 is a fragmentary enlarged view showing a specific configuration of a primary transfer region also included in the embodiment.

FIG. 3 shows a part of the primary transfer region or belt transfer region included in the copier 1. In FIG. 3, the same structural elements as the elements shown in FIG. 1 are designated by the same reference numerals. In FIG. 3, the bias roller 20*a* and ground roller 20*b* are located at positions different from the positions shown in FIG. 1 in order to facilitate an understanding. As shown, a charger 71 is positioned upstream of the primary transfer region in the direction of movement of the belt 19. The charger 71 deposits on the belt 19 a charge of the same polarity as the charge of the toner image before the transfer of the toner image from the drum 9 to the belt 19. The charger 71 may be implemented by a corona charger by way of example.

Why the configuration shown in FIG. 3 is successful to reduce the scattering of toner at the time of image transfer will be described hereinafter. The following description relates to both the transfer drum system and intermediate transfer system discussed earlier.

Figure 4A:
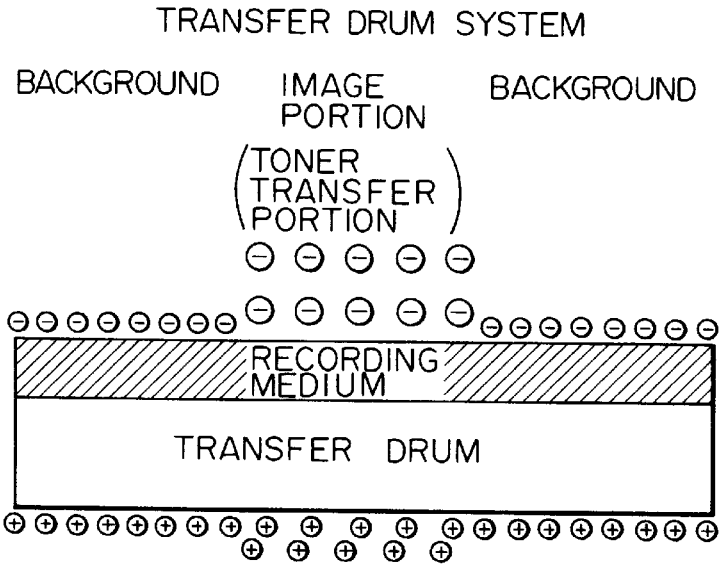
FIGS. 4A and 4B show estimated charge models at a position downstream of a transfer nip.
Figure 4B:
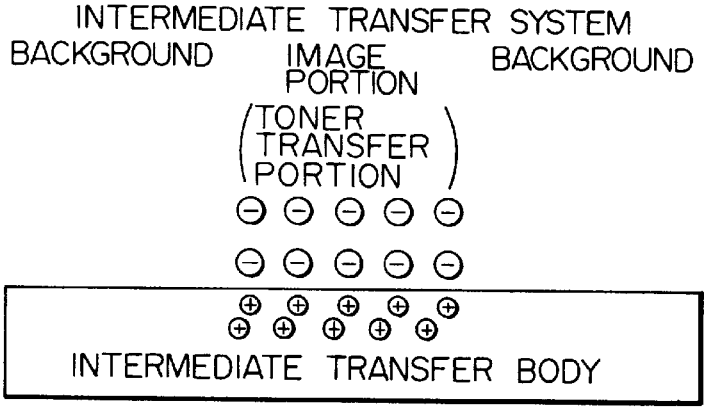

FIGS. 4A and 4B show estimated charge models at a position downstream of a transfer nip. As shown in FIG. 4A, in the case of the transfer drum system:

1) After the transfer of toner of the first color, a discharge charge substantially matching in amount the charge of the above toner deposits on the background of a drum.
2) After the transfer of toner of the second color, a charge deposits on the background in substantially the same amount as at the time of the transfer of the first color. However, because of the charge already deposited on the background, the total amount of charge in the background substantially matches the total amount of charge of the toners. Such an amount of charge sets up an electrically stable state.

It may therefore be safely said that in the case of the transfer drum system, the amount of charge is electrostatically uniform throughout the image portion and background. This prevents the charge of the drum, if any, around the above areas from acting as a noise electric field intense enough to scatter the toner.

As shown in FIG. 4B, in the case of the intermediate transfer system:

1) After the transfer of toner of the first color, a discharge charge substantially matching in amount the charge of the above toner falls onto the background and a recording medium, as in the transfer drum system. However, the discharge charge disappears instantaneously because an intermediate transfer body has a medium resistance.
2) This is also true with the toners of the second and successive colors. As a result, the charge concentrates on the image portion, resulting in an extremely unstable state.
3) On the other hand, a bias roller for applying a primary transfer bias exists at a position downstream of a transfer nip. Therefore, an electric field (noise electric field) acts sideways on the toner located at the edges of the image portion toward the background. Presumably, this electric field becomes more intense as the height of the toner increases.

In this manner, as for the intermediate transfer system, the amount of charge is electrostatically not uniform in the image area and background area. In this condition, the charge of a photoconductive element, if any, around the image portion acts as a noise electric field and scatters the toner.

In light of the above, the charger 71 shown in FIG. 3 deposits a charge identical in polarity with the toner image on the belt 19 before the primary transfer of the toner image. The charge renders the amounts of charge in the image area and background area substantially uniform, thereby reducing the intensity of the noise electric field.

To prove the above effect, a series of experiments were conducted. First, two seamless endless belts produced by extrusion molding and formed of carbon-containing polycarbonate were prepared. The two belts had a film thickness of 150 $\mu$m and respectively had surface resistance ($\rho s$) of $1\times10^{9}$ $\Omega$ cm$^2$ and $1\times10^{10}$ $\Omega$ cm$^2$. A painting liquid with an adequately adjusted amount of carbon black was sprayed onto the surfaces of the two belts (thickness after drying: 20 $\mu$m) and then dried at 100° C. for 1 hour. Belts A and B produced by such a procedure respectively had volume resistivities ($\rho v$) of $1\times10^{14}$ $\Omega$ cm and $1\times10^{12}$ $\Omega$ cm. The volume resistivities were measured for 10 seconds by applying biases of 100 V ($\rho v$) and 500 V ($\rho s$). For the measurement, use was made of a measuring device Hiresta IP (MCP-HT260) (trade name) available from Mitsubishi Petrochemical and a probe HRS Robe.

The above seamless belts A and B each was mounted to the copier 100 shown in FIG. 1. The scattering of toner on each of the belts A and B was evaluated after the primary transfer in the bicolor mode (C→M). The evaluation was effected with respect to the case wherein a charger was located upstream of a primary transfer region (corresponding to the charger 71 shown in FIG. 3) and a negative charge of 20 nC/c/c was applied to each belt before the primary transfer of C and M and the case lacking such a charger and negative charge. The results of evaluation are listed in Table 1 below. Toners used for the evaluation had a charge of 17 $\mu$C/gr to 22 $\mu$C/gr. The results were ranked "1 (lowest)" to "5 (highest)".

TABLE 1

| | Negative Charge Before Primary Transfer | |
|---|---|---|
| | Deposited | Not Deposited |
| Seamless Belt A | 5 | 3 |
| Seamless Belt B | 2 | 1 |

As Table 1 indicates, with the belt B whose volume resistivity is $1\times10^{12}$ $\Omega$ cm, the degree of scattering is as noticeable as with the conventional belt (5) discussed in the background of the invention without regard to whether or not the negative charge was deposited before the primary transfer. By contrast, with the belt A having a higher volume resistivity, the scattering is far less than with the belt B when the negative charge is deposited before the primary transfer. When the negative charge is not deposited before the primary transfer, the scattering with the belt A is less than the scattering with the belt B, but is not improved as much as when the negative charge is deposited.

It will be seen from the above that the scattering of toner is noticeably reduced when use is made of the belt A having a high volume resistivity and when the negative charge is deposited on the belt A before the primary charge. This suggests that the charge model shown in FIG. 4B is correct. On the other hand, with the belt B having a low volume resistivity, the scattering was not reduced even when the negative charge was deposited before the primary charge. This is presumably because the volume resistivity of the belt B was too low to hold the negative charge deposited before the primary transfer up to the position downstream of the nip. With the belt A, the scattering was reduced even when the negative charge was not deposited before the primary transfer, as stated above. This is presumably because the discharge charge deposited on the belt A at the outlet of the nip was continuously held. However, the discharge charge deposited on the belt A at the outlet of the nip due to the transfer of the first color has already disappeared, and only the discharge charge deposited at the outlet of the nip due to the transfer of the second color is held on the belt A. In this condition, the negative charge in the background is presumably too short to improve the scattering to the desired degree.

The above evaluation indicates that the charge model shown in FIG. 4B is correct. Therefore, when the charge identical in polarity with the toner image is deposited on the belt 19 before the primary charge, the phenomenon shown in FIG. 4B occurs. As a result, the scattering can be reduced when different colors are superposed. In addition, the illustrative embodiment does not deteriorate the paper-free feature while the conventional transfer and fixation using a pressure deteriorates it.

In the experiments described above, the charge is not deposited on the belt before the primary transfer of the first color for the following reason. In FIG. 3, assume that the charge deposition before the primary transfer occurs at a position X. Then, the charge deposited on the belt 19 is held up to a position Y at to the outlet of the nip where the scattering occurs. On the other hand, a discharge occurs on the belt 19 at the outlet of the nip with the result that a discharge charge identical in polarity with the toner and substantially matching the charge of the transferred toner (image portion) is deposited on the background of the belt 19. Let such a charge be labeled $Q_{1C}$. In the transfer condition wherein the charge deposited at the position X is held up to the position Y, the charge $Q_{1C}$ deposited at the outlet of the nip is, of course, held up to the position Y. This is why the charge deposition at the position X is not necessary at the time of the primary transfer of the first color.

The amount of charge to be deposited at the time of the primary transfer of the second and successive colors will be described. At the time of the primary transfer of the second color (2C), a discharge charge ($Q_{2C}$) matching the charge of the transferred toner is deposited on the image portion and background of the belt 19 at the outlet of the nip in the same manner as at the time of the primary transfer of the first color (1C). However, because the belt 19 has a medium resistance, the charge ($Q_{1C}$) derived from the first color still remains in the image portion, but has already disappeared in the background. Consequently, the amount of toner deposition after the primary transfer of the second color is about $Q_{1C}+Q_{2C}$ in the image portion and about $Q_{2C}$ in the background, as measured at the outlet of the nip. Such a difference also occurs in the tricolor mode and quadricolor mode for the same reason. Such amounts of charge are listed in Table 2 below.

TABLE 2

| | Charge in Image Portion | Charge in Background | ΔQ (Image Portion − Background) |
|---|---|---|---|
| After 2C Transfer | $Q_{1C} + Q_{2C}$ | $Q_{2C}$ | $Q_{1C}$ |
| After 3C Transfer | $Q_{1C} + Q_{2C} + Q_{3C}$ | $Q_{3C}$ | $Q_{1C} + Q_{2C}$ |
| After 4C Transfer | $Q_{1C} + Q_{2C} + Q_{3C} + Q_{4C}$ | $Q_{4C}$ | $Q_{1C} + Q_{2C} + Q_{3C}$ |

In Table 2, $Q_{1C}$ is the amount of discharge charge for a unit area to be deposited on the belt 19 at the time of the primary transfer of the first color 1C. $Q_{2C}$, $Q_{3C}$ and $Q_{4C}$ respectively denote the amounts of discharge relating to the second color 2C, third color 3C, and fourth color 4C.

As Table 2 indicates, to obviate the difference in the amount of charge between the image portion and the background, it is necessary that a charge corresponding to ΔQ shown in Table 2 be applied to the belt 19 before the primary transfer. That is, it is necessary to increase the amount of charge stepwise every time each of the colors 2C, 3C and 4C is superposed. In the illustrative embodiment, the charge to be deposited on the belt 19 by the charger 71 is so controlled as to satisfy a relation:

$$Q4 \geqq Q3 \geqq Q2$$

Figure 5:
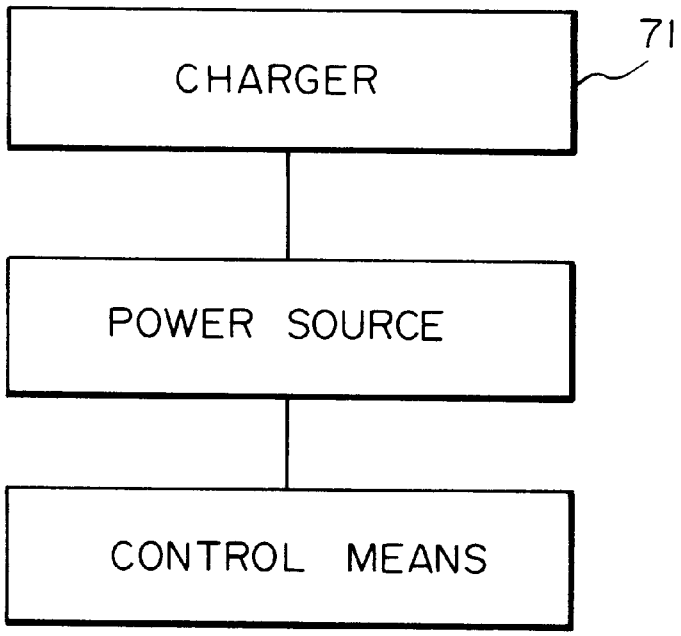
FIG. 5 is a block diagram schematically showing a control arrangement particular to the embodiment.

Specifically, control means shown in FIG. 5 stores the amounts of charge for a unit area to be deposited by the charger 71 and shown in Table 2 color by color (2C, 3C and 4C). The control means controls the output of a power source, not shown, such that the charger 71 deposits the charges listed in Table 2 on the belt 19.

The belt 19 included in the illustrative embodiment will be described more specifically. The embodiment obviates the difference in the amount of charge between the image area and the background by depositing the charge on the belt 19 before the primary transfer, as stated above. This cannot be done unless the charge deposited on the belt 19 at the position X, FIG. 3, is held on the belt 19 up to the position Y, FIG. 3. That is, the charge must be held on the belt 19 up to at least the transfer bias roller 20*a*, FIG. 3, located downstream of the nip. The characteristic of the belt 19 (sometimes referred to as an intermediate transfer body hereinafter) satisfying the above condition is as follows.

Generally, a period of time τ necessary for a charge to migrate through the intermediate transfer body is expressed as:

$$\tau = \epsilon 0 \cdot \epsilon B \cdot \rho V$$

where ε0 is the vacuum dielectric constant, εB is the specific inductive capacity of the intermediate transfer body, and ρV is the volume resistivity of the intermediate transfer body.

Therefore, in the apparatus of the type depositing the charge identical in polarity with the toner on the belt before the primary transfer, (ρV, εB) of the intermediate transfer body used must satisfy a relation:

$$L1/VL < \epsilon 0 \cdot \epsilon B \cdot \rho V \quad (1)$$

where L1 is the circumferential length of the intermediate transfer body between the charge depositing position and the transfer bias roller for the primary transfer, and VL is the linear velocity of the intermediate transfer body.

On the other hand, the intermediate transfer system using the intermediate transfer body having a medium resistance does not need, e.g., a discharging step. However, the prerequisite is that the charge deposited on the intermediate transfer body due to discharge during primary transfer disappears at least before the next primary transfer (multicolor mode) (condition (i)). This is also true with the secondary transfer for transferring the toner image from the intermediate transfer body to the recording medium (condition (ii)). Specifically, should the charge deposited on the intermediate transfer body by discharge during the primary transfer fail to disappear before the secondary transfer, the secondary transfer condition would become unstable and would prevent a desired image from being output because the amount of discharge charge is susceptible to, e.g., the environment. It is therefore necessary to satisfy the above two conditions (i) and (ii).

In the general intermediate transfer system causing the intermediate transfer body to rotate only in the forward direction, assume that the transfer body has a circumferential length of L, moves at a linear velocity of VL, and has a circumferential length L2 between the nip for the primary transfer and the transfer bias roller for the secondary transfer. Then, the interval (t1c−2c) between the primary transfer (1C) and the next primary transfer (2C) is expressed as:

$$(t1c-2c) = L/VL$$

The interval (tB−P) between the primary transfer and the secondary transfer is produced by:

$$(tB-P)=L/VL$$

Because L is greater than L2, there holds a relation of t1c−2c>tB−P. Therefore, if the charge on the surface of the intermediate transfer body disappears within the period of time tB−P, i.e., if the above condition (ii) is satisfied, the other condition (i) is automatically satisfied. It follows that (ρB, ϵB) of the intermediate transfer body must satisfy a relation:

$$\epsilon 0\cdot\epsilon B\cdot\rho V<L2/VL™ \quad (3)$$

The relations (1) and (2) indicate that the characteristic of the intermediate transfer belt satisfies the conditions (i) and (ii) if (ρV, ϵB) satisfies a relation:

$$L1/VL<\epsilon 0\cdot\epsilon B\cdot\rho V<L2/VL™ \quad (3)$$

Therefore, if use is made of the intermediate transfer belt satisfying the above relation (3), the charge deposited on the belt at the position X, FIG. 3, can be maintained up to the position Y, FIG. 3, at the outlet of the nip where the scattering occurs.

The configuration of the embodiment at the downstream side of the primary transfer region will be described hereinafter. By depositing the charge identical in polarity with the toner image on the intermediate transfer belt before the primary transfer, it is possible to obviate the difference in charge between the image portion and the background and therefore to reduce the scattering at the downstream side of the nip, as stated earlier. Technically, however, it is difficult to fully equalize the charge of the image portion and that of the background. The above difference in charge forms an electric field causing the toner to move from the edges of the image toward the background.

In light of the above, as shown in FIG. 3, the transfer bias roller 20*a* is positioned downstream of the primary transfer region and plays the role of an electrode for the primary transfer. In addition, the ground roller 20*b* is located upstream of the primary transfer region and held in contact with the drum 9 via the belt 19. The ground roller 20*b* is connected to ground.

Why the configuration shown in FIG. 3 successfully reduces the scattering of toner is as follows. The scattering at the outlet of the nip is ascribable to the electric field formed by (i) the charge of the latent image formed on the drum 9, (ii) the charge of the toner deposited on the image area of the belt 19, (iii) the charge deposited on the background of the belt 19, and (iv) the transfer charge existing in or on the rear of the belt 19 and applied from the outside for the primary transfer. Among them, the charges (ii) and (iii) are the prime movers acting on the toner sideways (in parallel to the belt 19). With the configuration described so far, the embodiment weakens the electric field formed by the charges (ii) and (iii) by obviating the difference between them. However, it is difficult to fully obviate the difference between the charges (ii) and (iii), as stated earlier.

In the illustrative embodiment, the electric field acting on the toner vertically (vertically to the belt 19) is intensified in order to reduce the scattering. Stated another way, the vertical vector acting on the toner is intensified in order to change the direction of a force represented by the sum of the horizontal and vertical vectors acting on the toner to a degree acceptable in practice. Specifically, while the electric field acting on the toner vertically is governed by the charges (i) and (iv), the charge (i) is unconditionally determined by the image forming conditions of the drum 9 and therefore cannot be selected at random. Therefore, the charge (iv) is used to increase the amount of charge and therefore the electric field acting on the toner vertically. The charge (iv) can be increased by the transfer bias roller 20*a* and ground roller 20*b* shown in FIG. 3 and if the transfer bias to be applied to the roller 20*a* is increased.

As stated above, it is possible to reduce the scattering at the downstream side of the nip by increasing the bias to be applied to the transfer bias roller 20*a*. However, although the scattering at the downstream side of the nip may be reduced, the scattering cannot be fully obviated. The scattering occurs not only at the downstream side (outlet) of the nip but also at the upstream side (inlet) of the nip, as stated previously. The scattering at the upstream side must also be reduced.

Specifically, if the transfer charge deposited on the belt 19 leaks to the upstream side of the nip, then a potential gradient reaching the inlet of the nip (gap immediately preceding the position where the drum 9 and belt 19 contact) is generated and forms an electric field on the belt 19. This electric field causes the toner transfer from the drum 9 to the belt 19 to occur before the latter contacts the former (so-called pretransfer). The pretransfer occurs at a position slightly deviated from the position of transfer at the nip, resulting in the scattering.

To reduce the scattering occurring at the upstream side (inlet) of the transfer nip, the ground roller 20*b* connected to ground is held in contact with the drum 9 via the belt 19, i.e., with the rear of the belt 19, as shown in FIG. 3. In this condition, the charge deposited on the belt 19 by the bias roller 20*a* is released to ground via the ground roller 20*b*. This prevents the potential gradient from being generated on the belt 19 upstream of the point where the ground roller 20*b* contacts the belt 19. More specifically, the transfer charge is dissipated in the transfer nip with the result that the formation of an electric field on the belt 19 is suppressed. Consequently, the scattering at the upstream side (inlet) of the transfer nip is reduced or obviated. It is to be noted that to guarantee a substantial transfer nip width, the ground roller 20*b* should preferably be located at or in the vicinity of the start point of the transfer nip.

Figure 6:
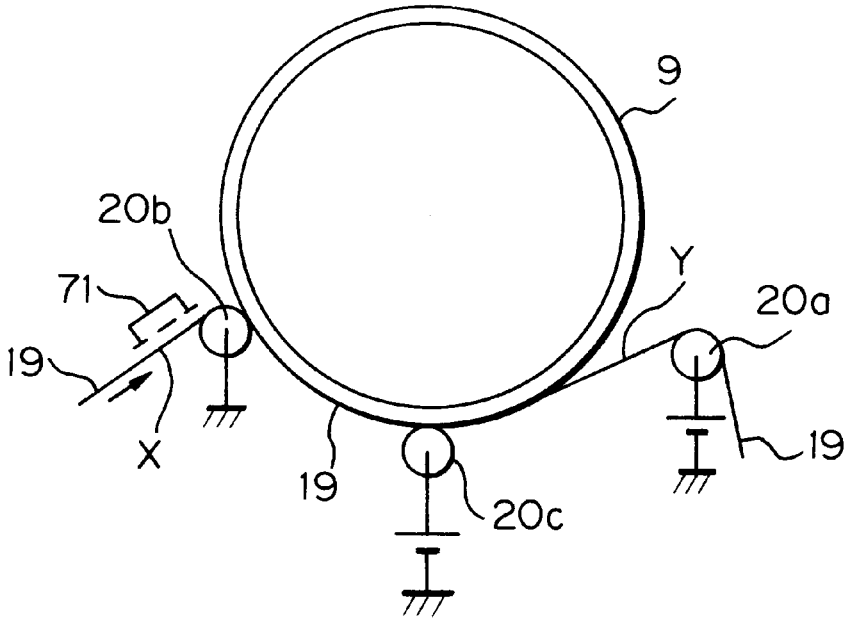
FIG. 6 is a fragmentary enlarged view showing another specific configuration of the primary transfer region.

FIG. 6 shows another specific configuration of the primary transfer region. In FIG. 6, the same structural elements as the elements shown in FIG. 3 are designated by the same reference numerals. As shown, a transfer bias roller 20*c* is positioned at the intermediate between the inlet and the outlet of the transfer nip. The transfer bias applied to the bias roller 20*b* is also applied to the bias roller 20*c*.

Assume that, as shown in FIG. 3, a transfer bias is applied from the bias roller 20*a* located downstream of the nip to toward the ground roller 20*b* located upstream of the nip. Then, the belt 19 has a potential gradient extending from the bias roller 20*a* toward the ground roller 20*b*, so that the charge sequentially decreases toward the ground roller 20*b*. By contrast, when the same transfer bias is applied to the center and downstream side of the nip, as shown in FIG. 6, the potential at the center and the potential at the downstream side are equal to each other. This allows the previously mentioned electric field (iv) acting on the toner vertically to be intensified. Therefore, the configuration of FIG. 6 obviates the scattering more effectively than the configuration of FIG. 3.

In summary, in accordance with the present invention, charges deposited on the image area and background of a belt or intermediate transfer body are substantially equal to each other, so that a charge deposited on the belt at a particular position before primary transfer can be held up to the outlet of a transfer nip. This reduces the intensity of a noise electric field acting sideways toward the background which causes the scattering of toner to occur. It is therefore possible to reduce the scattering in the event of color superposition without deteriorating a paper-free characteristic.

Various modifications will become possible for those skilled in the art after receiving the teachings of the present disclosure without departing from the scope thereof. For example, the drum 9 may be replaced with any other suitable photoconductive element, e.g., a belt. Also, the belt 19 may alternatively be implemented as a drum, roller or any other suitable intermediate transfer body. The electric characteristic (volume resistivity and surface resistance), thickness and structure (single layer, double layer or the like) of the intermediate transfer body may be suitably selected in matching relation to various conditions including image forming conditions. Of course, the intermediate transfer member may be formed of any suitable material. The transfer bias roller 20*a* may be replaced with a conductive brush (metal or resin), a conductive blade (metal, resin or rubber) or any other suitable member or may even be implemented by a corona discharger. This is also true with the transfer bias roller 23*a* assigned to the secondary transfer or paper transfer. The transfer charge may be deposited on the intermediate transfer body at a position included in the transfer nip. The voltages for the primary transfer shown and described are only illustrative and may be changed in accordance with the image forming conditions. The ground roller 20*b* may also be implemented as a conductive brush (metal or resin) or a conductive blade (metal, resin or rubber) by way of example, and may be located at any desired position within the transfer nip.

What is claimed is:

1. An image forming apparatus comprising:

an image carrier for carrying a toner image thereon;

a primary transfer electrode for effecting primary transfer of said toner image from said image carrier to an intermediate transfer body electrostatically;

a secondary transfer electrode for effecting secondary transfer of said toner image from said intermediate transfer body to a recording medium electrostatically; and charge depositing means for depositing, before said primary transfer, a charge identical in polarity with a charge of said toner image on said intermediate transfer body.

2. An apparatus as claimed in claim 1, wherein after said primary transfer has been repeated to sequentially transfer a plurality of toner images to said intermediate transfer body one upon the other, a resulting composite toner image is transferred to the recording medium by said secondary transfer.

3. An apparatus as claimed in claim claim 2, further comprising control means for sequentially increasing, in accordance with continuous primary transfer of a plurality of colors, an amount of charge which said charge depositing means deposits on said intermediate transfer body for a unit area.

4. An apparatus as claimed in claim 2, wherein said charge depositing means deposits said charge on said intermediate transfer body before said primary transfer of a second and successive toner images.

5. An apparatus as claimed in claim 1, wherein said primary transfer electrode is located at a position downstream, with respect to a direction of movement of said intermediate transfer body, of a position where said intermediate transfer body and said image carrier contact each other.

6. An apparatus as claimed in claim 5, wherein said primary transfer electrode deposits said charge in contact with said intermediate transfer body.

7. An apparatus as claimed in claim 1, wherein said primary transfer electrode comprises a plurality of primary transfer electrodes located at a position where said intermediate transfer body and said image carrier contact each other and at a position downstream of said position with respect to a direction of movement of said intermediate transfer body.

8. An image forming apparatus comprising:

an image carrier for carrying a toner image thereon; and an intermediate transfer body to which said toner image is transferred from said image carrier;

wherein assuming that said intermediate transfer body has a volume resistivity of ρV and a specific inductive capacity of εB, (ρV, εB) satisfies a relation:

$$L1/VL \ll \epsilon 0 \cdot \rho V < L2/VL$$

wherein L1is a circumferential length of said intermediate transfer body between a charge depositing position preceding a primary transfer position and a primary transfer bias roller, L2 is a circumferential length of said intermediate transfer body between a primary transfer nip position and a secondary transfer bias roller, VL is a linear velocity of said intermediate transfer body, and ε0 is a vacuum dielectric constant.

9. An image forming apparatus comprising:

an image carrier for carrying a toner image thereon;

an intermediate transfer body held in contact with said image carrier and to which said toner image is electrostatically transferred from said image carrier; and an electrode for reducing, at a position where said image carrier and said intermediate transfer body contact each other, a transfer charge deposited on said intermediate transfer body.

10. An apparatus as claimed in claim 9, wherein said electrode contacts, at said position, a surface of said intermediate transfer body opposite to a surface contacting said image carrier.

11. An apparatus as claimed in claim 9, wherein said electrode is connected to ground.

12. An apparatus as claimed in claim 9, wherein said electrode is positioned at a point where said intermediate transfer body and said image carrier begins to contact each other or a point adjacent to said point.

13. An image forming apparatus comprising:

a secondary transfer electrode for effecting secondary transfer of a toner image from an intermediate transfer body to a recording medium electrostatically; and charge depositing means for depositing a charge identical in polarity with said toner image on said intermediate transfer body before said primary transfer.

14. An image forming apparatus comprising:

an image carrier for carrying a toner image thereon;

a primary transfer electrode for effecting primary transfer of said toner image from said image carrier to an intermediate transfer body electrostatically;

charge depositing means for depositing a charge identical in polarity with said toner image on said intermediate transfer body before said primary transfer; and an electrode for reducing, at a position where said image carrier and said intermediate transfer body contact each other, a transfer charge deposited on said intermediate transfer body.

15. An image forming method comprising:

a primary transfer step for transferring a toner image from an image carrier to an intermediate transfer body electrostatically;

a secondary transfer step for transferring said toner image from said intermediate transfer body to a recording medium electrostatically; and a step of depositing a charge identical in polarity with said toner image on said intermediate transfer body before said primary transfer step.

16. A method as claimed in claim 15, wherein after said primary transfer step has been repeated for sequentially transferring a plurality of toner images from said image carrier to said intermediate transfer body one upon the other, a resulting composite toner image is transferred from said intermediate transfer body to the recording medium by said secondary transfer, and wherein said step of depositing said charge is effected before a second and successive primary transfer steps.

17. A method as claimed in claim 15, wherein in said step of depositing said charge, an amount of charge to be deposited on said intermediate transfer body for a unit area is sequentially increased in accordance with said primary transfer repeated with a plurality of colors.

18. An image forming method comprising:

a primary transfer step for transferring a toner image from an image carrier to an intermediate transfer body electrostatically; and a secondary transfer step for transferring said toner image from said intermediate transfer body to a recording medium electrostatically;

wherein a transfer charge deposited on said intermediate transfer body is reduced at a position where said image carrier and said intermediate transfer body contact each other.

19. A method as claimed in claim 18, wherein said transfer charge of said intermediate transfer body is reduced at a surface of said intermediate transfer body opposite to a surface contacting said image carrier.

* * * * *